United States Patent [19]

Mohr

[11] 3,999,572

[45] Dec. 28, 1976

[54] FLUID FLOW INSTRUMENTALITY

[75] Inventor: Paul R. Mohr, Phoenix, Ariz.

[73] Assignee: The Garrett Corporation, Los Angeles, Calif.

[22] Filed: Mar. 24, 1975

[21] Appl. No.: 561,382

[52] U.S. Cl. ..... 137/601

[51] Int. Cl.[2] ..... F17D 1/14

[58] Field of Search ..... 137/1, 599, 601

[56] References Cited

UNITED STATES PATENTS

| | | | |
|---|---|---|---|
| 1,623,557 | 4/1927 | Rybeck | 137/625.27 |
| 2,229,903 | 1/1941 | Schmohl et al. | 137/599 |
| 2,865,397 | 12/1958 | Chenault | 137/501 X |
| 2,934,448 | 4/1960 | Patton | 137/604 X |
| 3,072,146 | 1/1963 | Gizeski | 137/599 X |
| 3,286,636 | 11/1966 | Schaub | 137/110 X |
| 3,294,105 | 12/1966 | Schaub | 137/110 |
| 3,357,359 | 12/1967 | Schaub | 137/110 X |
| 3,746,401 | 7/1973 | Stearns | 137/624.27 X |
| 3,830,256 | 8/1974 | Cox | 137/599 |
| 3,886,971 | 6/1975 | Lundsgaard et al. | 137/599 |

*Primary Examiner*—Alan Cohan
*Assistant Examiner*—Gerald A. Michalsky
*Attorney, Agent, or Firm*—James W. McFarland; Albert J. Miller

[57] ABSTRACT

A fluid flow control system having a control valve which maintains a constant output flow rate regardless of input flow pressure variations. Three such constant flow valves are disposed in parallel to common inlet and exhaust headers, and hydraulically detented pilot control valves are selectively actuated to vary exhaust flow from the system in discrete steps. A web arrangement in the exhaust header prevents interaction of velocity heads between the flows coming from the three constant flow valves.

3 Claims, 6 Drawing Figures

FLUID FLOW INSTRUMENTALITY

This invention relates generally to fluid flow control instrumentality, and relates more particularly to a control system for automatically maintaining a preselected flow rate output from a variable pressure fluid source.

In certain liquid flow systems it is desirable to use a single fluid source to simultaneously perform two or more different functions or perform work at different locations. A problem inherent to such systems is that the flow path encountering least resistance tends to starve the other flow paths, and constant or desired flows cannot be maintained. Thus, each flow path is in essence supplied from a variable pressure source. In other systems the fluid source itself is of variable pressure and flow characteristics which affect the downstream flow rates to the point or points of work.

One example of such a system wherein such problems of flow variance can be critical is in fire fighting equipment. Conventionally, a nonpositive displacement, variable flow fluid source in an engine pumper is desired to be utilized to supply waterflow to a plurality of separate hoses and fire fighting locations. As necessary, the exhaust nozzle of each hose is selectively varied to produce the desired quantity and shape of flow stream. To maintain independent operation of each hose it is therefore necessary that a separate upstream orifice be varied in correlation with change in the exhaust nozzle to avoid the undesired starvation or excess flow to other hoses supplied by the one pump.

Prior solutions to this problem have required additional fireman to monitor pressures of flows to the different hoses and vary upstream orifices associated with each hose to attempt to reduce the interdependence and maintain desired and adequate flow supply to each hose. Thus, additional highly trained firefighters must be utilized to permit a single pump unit to supply a plurality of hoses.

It is an important object of the present invention to provide automated method and apparatus for allowing a single pump unit to supply fluid to a plurality of parallel flow paths, such as different firefighting hoses, without requiring constant manual monitoring and highly skilled manipulation of supply valves controlling flow to the different paths.

Another important object is to provide improved method and apparatus for maintaining a desired rate of flow through each path that is independent of the conditions in the other flow paths.

A further important object in a system as set forth in the preceding object is to provide improved method and apparatus for changing the desired rate of flow without affecting flow through other flow paths.

A more particular object is to provide method and apparatus for one flow path which divides flow therethrough into a plurality of parallel sub-paths, regulates flow through each sub-path to a preselected value regardless of other conditions in the overall system, and then combines the regulated flows from the sub-paths into a single exhaust flow. The rate of the single exhause flow is then selectively varied by blocking flow through any one or more of the sub-paths.

Another important object of this invention is to provide improved method and valve structure for effecting the selective blockage of flow through the sub-path.

Yet another object is to provide improved valve and method for regulating flow through a sub-path to the desired preselected value by utilizing a nonclosing, variable area orifice valve that is automatically positioned in response to the pressure drop thereacross so as to maintain the constant flow rate. A separate shut-off valve downstream of the variable orifice is actuated to selectively block flow through the sub-path, so that even at excess flow conditions exceeding the design capabilities of the variable orifice, fluid flow is not blocked and water is still available at the exhaust nozzle of the fire fighting hose.

A further object of the invention is to provide improved method and apparatus for combining the separate regulated flows from the sub-paths without interaction between the velocity heads of the different flows to thereby avoid spurious variations in the single exhaust flow rate.

Another object is to provide in systems as set forth in the preceding objects, apparatus for manually controlling flow rates in the event of failure or malfunction.

These and other objects and advantages of the present invention are specifically set forth in or will become apparent from the following detailed description of a preferred embodiment of the invention when read in conjunction with the accompanying drawings, wherein.

Figure 1:
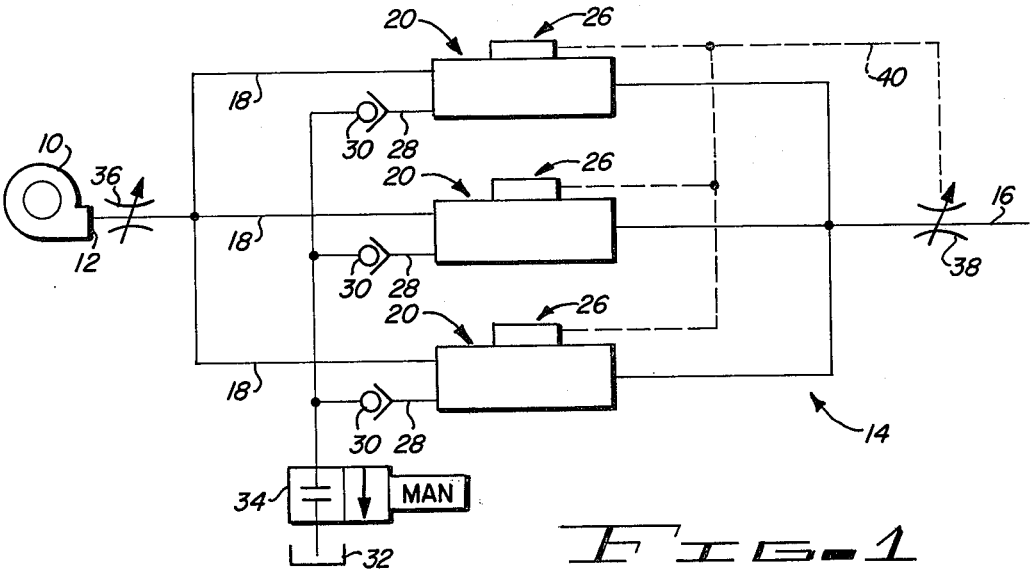
FIG. 1 is schematic representation of a fluid flow control system embodying the principles of the present invention and utilized in conjunction with fire fighting equipment.

Referring now more particularly to the drawings, FIG. 1 is a schematic illustration of the present invention as incorporated into fire fighting equipment. Fluid from a variable pressure, variable flow fluid source, such as nonpositive displacement, centrifugal pump 10 supplies flow through a discharge duct 12 to a flow control system generally designated by numeral 14. A regulated exhaust flow from system 14 is delivered to an associated fire hose 16. In actual use several such systems 14 and associated hoses 16 would be connected in parallel flow relationship with discharge duct 12.

Figure 5:
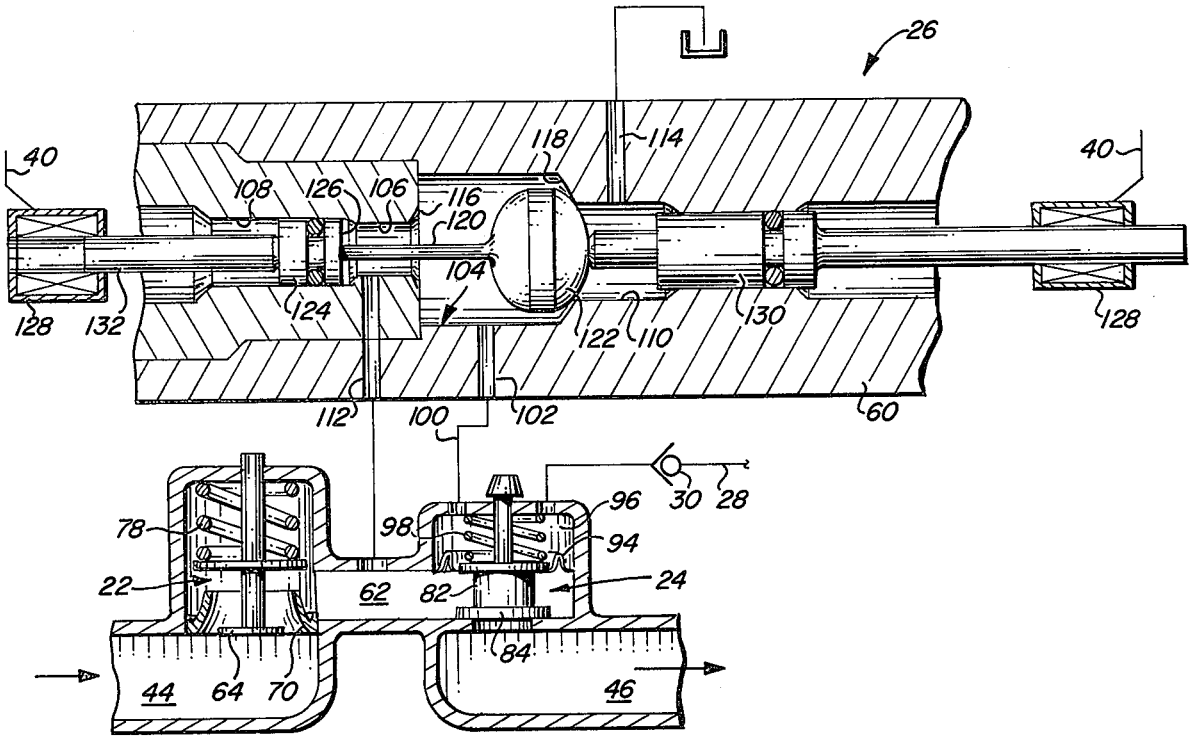
FIG. 5 is a partially schematic cross-sectional representation of the flow control valve and the improved spool valve utilized to control action of the shut-off valve.
Figure 6:
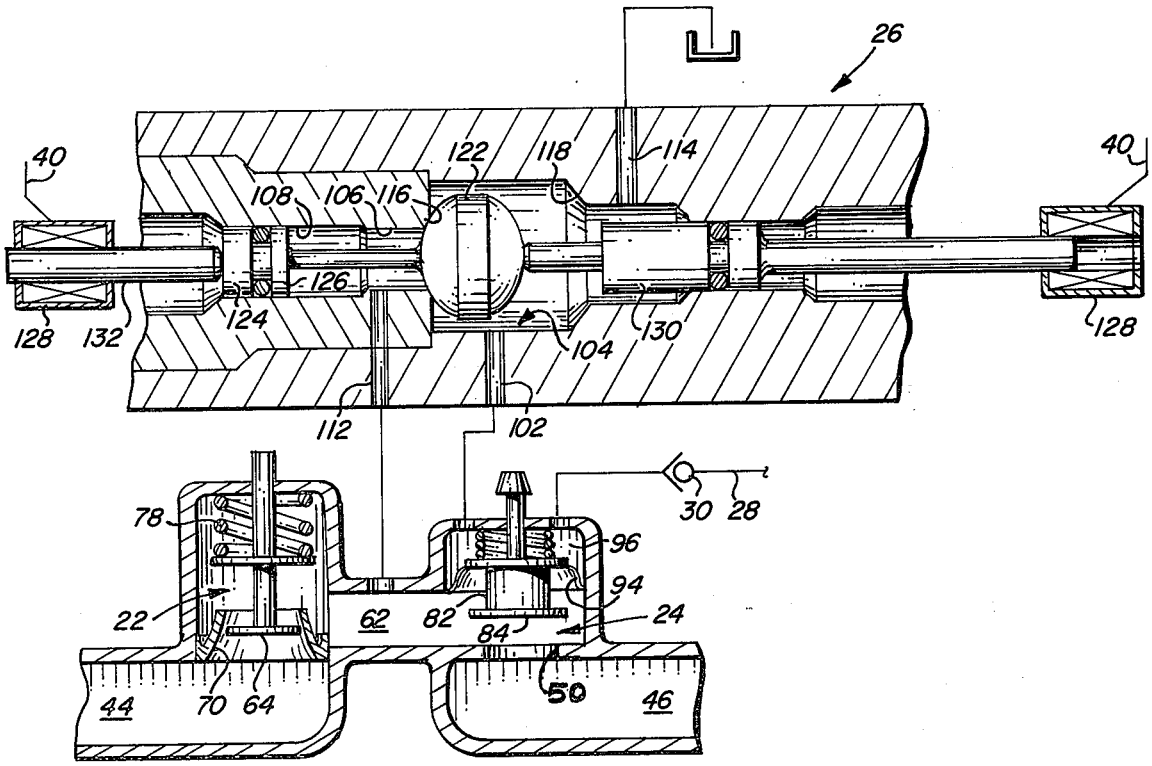
FIG. 6 is a view similar to FIG. 5 but showing the valves in different operating conditions.

System 14 includes a plurality of operably parallel conduits 18 communicating with discharge duct 12 and hose 16. In each conduit is disposed a valve assembly 20 comprising a flow regulating valve 22 and shut-off valve 24, as shown in FIGS. 3–6, and a solenoid operated control valve 26, as shown in FIGS. 5–6. Valves 22, 24, 26 are described in detail below. Each valve assembly 20 also includes a low pressure exhaust conduit 28 communicable across one-way check valves 30 with a region of low pressure 32 dependent upon the position of a manual override means in the form of a blocking valve 34. Upstream of conduits 18 is a manually operable flow varying means depicted as a variable orifice 36. Associated with exhaust hose 16 is a manually varied exhaust nozzle 38 functioning as a downstream orifice. As depicted by dashed lines 40, an electrical signal is generated relative to the degree of restriction offered by nozzle 38, and such signal is fed back and utilized to energize and actuate solenoid operated valves 26.

Figure 2:
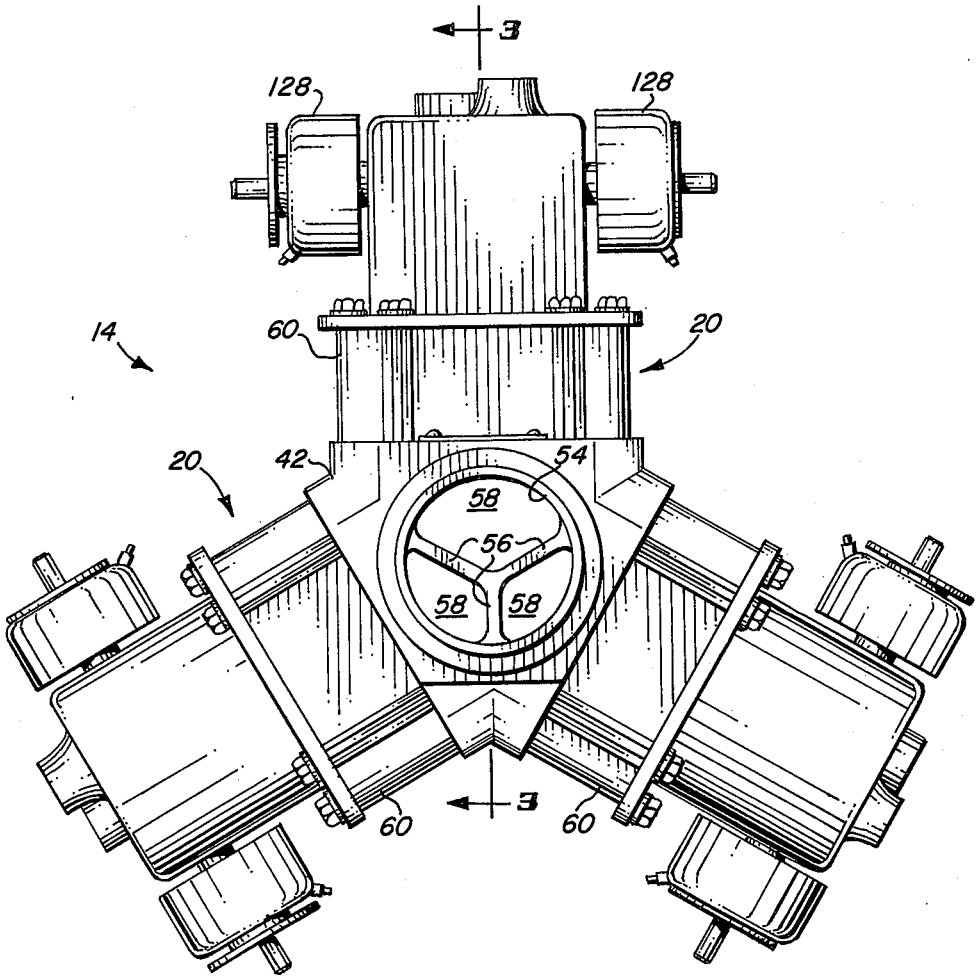
FIG. 2 is an end elevational view of a modular set of flow control valves utilized in the present invention.
Figure 3:
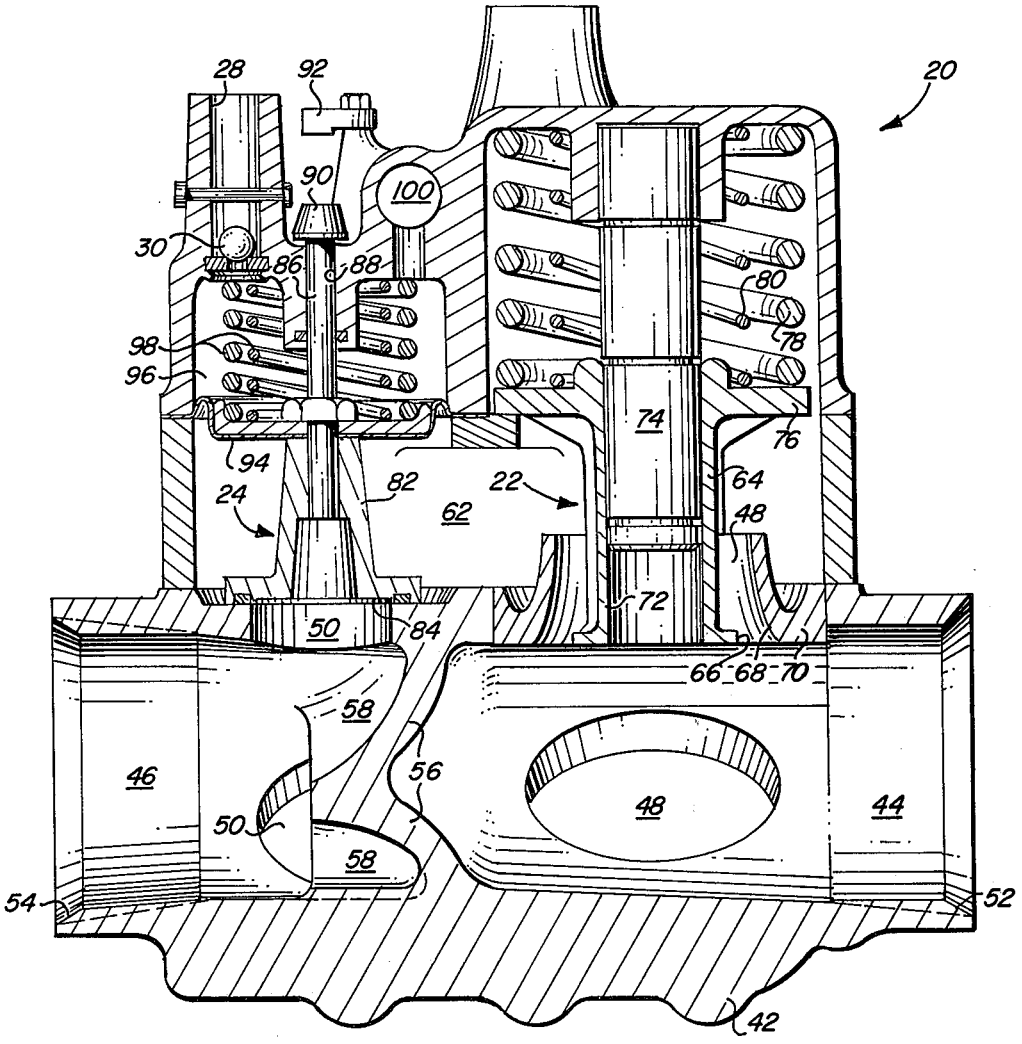
FIG. 3 is a cross-sectional elevational view of one automatic flow control valve as taken along lines 3—3 of FIG. 2.
Figure 4:
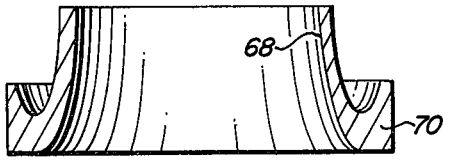
FIG. 4 is an enlarged, cross-sectional elevational view of the flow control seat insert.

Referring now to FIGS. 2 and 3, there is illustrated an axially extending, triangular unitary body 42 having three flat faces to which valve assemblies 20 are respectively secured. Body 42 defines separated inlet and exhaust headers in the form of axially extending internal passages 44 and 46. Three inlet ports 48 and three discharge ports 50 respectively connect each valve assembly with passages 44 and 46. Passage 44 has an inlet opening 52 communicating with the supply pump, while exhaust opening 54 at the other end of body 42 communicates with the exhaust hose passage 16.

Web structure, including a trio of integral webs 56, are disposed in internal passage 46 so as to define separated pocket zones 58 thereof that respectively directly communicate with ports 50 which function as inlet openings to passage 46. Webs 56, as can best be seen in FIG. 2, are asymmetrically arranged in passage 46 and extend a sufficient axial distance toward exhaust opening 54 so as to be able to deflect incoming flows from ports 50 into substantially parallel alignment prior to their combining and intermixing in passage 46.

Each valve assembly 20 includes a housing 60 having an internal duct 62 communicating with the associated inlet and discharge ports 48 and 50. Flow regulating valve 22 includes a movable disc-shaped poppet 64 having a face defining an outer peripheral circular surface 66 cooperating with an internal curved surface 68 of a seat insert 70 removably secured to body 42 at inlet port 48. Poppet 64 has a central through bore 72 that is in guiding contact with a dowel pin 74 secured to housing 60, and a circular flange 76 engaged by biasing means in the form of linear gradient, helical coil compression springs 78 and 80 which urge poppet 64 downwardly as viewed in FIG. 3.

Surfaces 66 and 68 define inner and outer limits of an annular orifice therebetween which restricts fluid flow from passage 44 to duct 62 and thereby creates a pressure differential acting upon poppet 64 to urge the latter upwardly in FIG. 3 against the bias of springs 78,80. The configuration of surfaces 66 and 68 is chosen to maintain a constant rate of flow through the port 48 regardless of pressure in chamber 44 and the pressure differential acting on poppet 64. More particularly, seat surface 68, as clearly illustrated in FIG. 4, approximates a fourth order curve in the direction of poppet movement such that the area of the annular orifice varies in such a manner with movement of poppet 64 that the product of that area times the square root of the pressure drop across the orifice remains substantially constant, thereby dictating a relatively constant rate of flow into duct 62. Preferably, seat 70 is releasably intersecurable to body 42 such that the constant rate of flow allowed therethrough may be altered simply by replacing seat 70 with another seat having an internal surface of different dimensions. Such arrangement also reduces the cost of valve assembly 20 since all components, including springs 78 and 80, of each valve 22 may be identical, yet different flow rates for each valve may be preselected simply by utilizing seat inserts with different internal surface dimensions.

It is important to note that the diameter of poppet surface 66 is less than the minimum diameter of seat internal surface 68. As a result, flow interruption or blockage can never occur at regulating valve 22. Thus, even upon exceeding the maximum flow and/or pressure ratings of valve 22 (which would occur with increase in chamber 44 pressure beyond that required to fully compress springs 78 and 80 to a "solid" condition), fluid flow still passes into duct 62 and is thereby available at the exhaust nozzle 16. It will be understood by those skilled in the art that further increase in chamber 44 pressure after the springs have gone solid will result in a rate of flow into duct 62 greater than the constant, preselected flow rate which valve 22 otherwise establishes. The relative diameters of surfaces 66 and 68 also facilitate simple assembly of the entire valve. By never totally blocking flow, the more sensitive regulating valve 22 is never subject to a large pressure differential in stand-by conditions when flow through duct 62 is blocked by the more massively designed shut-off valve 24. Regulating valve 22 also does not have to perform fluid sealing functions.

Shut-off valve 24 includes a movable poppet 82 having a lower flat face 84 adapted to sealingly engage body 42 adjacent discharge port 50 to block flow therethrough. Rigidly secured to poppet 82 is a central pin 86 sealingly and slidably received in a bore 88 of housing 60. Exterior to housing 60, pin 86 has an end section 90 of magnetic material capable of actuating a reed switch 92 upon nearing the latter with upward travel of poppet 82 and pin 86. Switch 92 may be connected with a suitable indicator lamp or other device to thereby provide remote indication of the position of poppet 82.

Poppet 82 includes a piston in the form of a diaphragm 94 traversing the interior of a portion of housing 60 to define a fluid actuating chamber 96. Biasing means in the form of a pair of compression springs 98 are disposed in chamber 96 and are engageable with the piston portion of poppet 82 to urge the latter towards its closed position depicted in FIG. 3. The exhaust conduit 28 communicates with chamber 96 across the one-way ball check valve 30 which acts to prevent reverse inflow from conduit 28 into chamber 96.

Another conduit 100 in housing 60 extends between chamber 96 and a work duct 102 associated with control valve 26, as depicted in FIGS. 5 and 6. While valve 26 is illustrated separately from valves 22 and 24 in FIG. 5, it will be understood that it is preferably contained in the same housing 60 as the other valves in the assembly and thus the conduit 100 and work duct 102 may be provided as a single passage in housing 60 extending between chamber 96 and an axial bore 104 associated with valve 26.

Bore 104 has at least three sections 106, 108, 110 of different diameters. Section 108 has a diameter intermediate that of smaller section 106 and larger section 110. In addition to work duct 102, an inlet duct 112 and fluid exhaust duct 114 respectively communicate with bore sections 106 and 110 at axially spaced positions on opposite sides of duct 102. inlet duct 112 communicates with a region of relatively higher pressure, the internal duct 62 of housing 60, while exhaust duct 114 leads to a low pressure return region of lower pressure. Between ducts 102 and 112 the housing presents a land 116, and presents another land 118 between ducts 102 and 114.

An axially shiftable flow control valve spool 120 is mounted within bore 104 and has a valving member 122 that is engageable with lands 116 and 118, as shown in FIGS. 5 and 6, to allow and prohibit fluid communication of work duct 102 with either of ducts 112 or 114. Spool 120 also carries a piston 124 that extends across section 108 of the bore to present a face 126 whose area is exposed to pressure of fluid in the inlet duct 112 in both positions of spool 120. A pair of solenoid actuators each of which includes an electrically energizable solenoid 128 and shiftable pins 130 and 132, engage opposite ends of spool 120 to shift the latter between its FIGS. 5 and 6 positions. Solenoids 128 are electrically coupled with the exhaust nozzle via conductors 40.

In operation, pressurized fluid flow is delivered from pump 10 to inlet passage 44 of body 42, thence through the parallel conduits 18 (inlet ports 48) into the internal ducts 62 of each valve assembly 20. The exhaust nozzle 38 is manually adjusted to the stream desired, resulting in an electrical feedback signal to the solenoid operated control valves 26. In response to this signal, the several valves 26 are individually shifted to either the FIG. 5 or FIG. 6 position. For those valves in the FIG. 5 position, pressure inlet fluid in duct 62 is communicated to chamber 96, creating equal pressure on opposite sides of diaphragm 94 to allow springs 98 to shift the poppet 82 of the shut-off valve to its closed position. Flow through such valve assemblies and the associated conduit 18 is thereby blocked. In the FIG. 5 closed position, an area of valve member 122 equal to the diameter of bore section 110 is exposed to duct 62 pressure to hold spool 120 in this closed position. It will be noted that duct 62 pressure is acting in an opposite direction upon the smaller area face 126 of piston 124 so that the difference in cross-sectional areas between sections 110 and 108 creates a net hydraulic force holding spool 120 in the closed position.

Other of valves 26 wherein the feedback signal energizes the right-hand end solenoid 128 have the spool 120 shifted leftwardly, as shown in FIG. 6, with member 122 engaging land 116 to permit draining of fluid from chamber 96. Thus, pressure in duct 62 acts on diaphragm 94 to open poppet 82 and allow fluid flow through the valve assembly to discharge passage 46. In this position, pressure from inlet duct 112 acts on the difference between face area 126 and an area of member 122 equal to the cross-sectional area of section 106 so that pressure acting on the larger area of piston face 126 produces a net hydraulic force holding spool 120 in its FIG. 6 open position. Energizing left-hand solenoid 128 will exert a sufficient force to overcome this hydraulic holding force and shift spool 120 back to its FIG. 5 position.

For such valve assemblies with shut-off valve 24 in the FIG. 6 open position, flow regulating valve 22 is operable, as described previously, to maintain a preselected rate of fluid flow into duct 62 and on toward passage 46 and the exhaust nozzle. The regulating valves 22 of the three valve assemblies 20 have seat inserts 70 of different size to provide three different constant rates of flow to the exhaust nozzle. Accordingly, the single exhaust flow passing from the exhaust opening 54 of system 14 may be varied through seven discrete steps by causing opening of any one or any combination of the shut-off valves 24. In each of these discrete steps the single exhaust flow is maintained relatively constant by the actions of regulating valves 22 regardless of pressure fluctuations at the fluid source. Thus, valves 22 automatically compensate for a change of condition to another exhaust hose supplied by pump 10, as well as source pressure fluctuations caused by any other external condition.

As can best be seen in FIGS. 2 and 3, the flow from the three discharge ports 50 enter passage 46 in opposing, interfering relationship to one another and approximately at right angles to the single exhaust flow passing axially out of exhaust opening 54. Webs 56 act to effectively deflect or turn the flow from discharge ports 50 into the direction of the axial exhaust flow. Because the separate flows from ports 50 do not combine until they are substantially parallel, the velocity head of one such inlet flow does not interfere with another inlet flow into passage 46. The webs 56 are asymmetrically positioned such that the size of the associated pocket zones 58 are in relation to the magnitude of the constant flow thereinto. In FIG. 2, for instance, the uppermost pocket zone 58 is largest in order to accommodate the largest of the three flows allowed by valve assemblies 20, and for the same reason the lower left-hand pocket zone is larger than the lower right-hand pocket zone. Without webs 56 the velocity head of the largest flow would, for instance, directly interfere with the smaller flows and develop a back-pressure thereto that would reduce the smaller flow rates. Webs 56 prevent such interference to assure that the single exhaust flow rate is in accord with the electrical feedback signal.

In instances of malfunction or for any other reason, the automatic flow control operation described may be manually overridden by shifting valve 34 in FIG. 1 to its open position to thereby drain the several shut-off valve chambers 96 to permit full flow through each valve assembly 20 regardless of the electrical feedback signals and positions of control valve spools 120. Variable restriction 36 may then be varied as desired to manually alter flow rate to exhaust nozzle 38. Check valves 30 prevent flow between the several shut-off valve chambers 96.

It will be apparent from the foregoing that there is provided a method of controlling fluid flow in discrete steps by dividing an inlet flow into three or more separate parallel flow paths, automatically regulating flow in each of these paths to different preselected rates, subsequently combining the regulated flows, and varying the single exhaust flow by selectively blocking flow through any one or combination of these parallel paths. The combining steps include directing the separate flows into a common chamber or passage 46, separately deflecting each flow into a common direction toward the exhaust opening, and then combining the deflected flows only after they are substantially parallel. Automatic flow regulation is accomplished by directing a flow in one of the paths through an annular orifice, and utilizing the pressure drop across the orifice to move poppet 64 so as to vary the area of the opening in a manner maintaining constant flow rate therethrough regardless of pressure fluctuations. Flow through that path is selectively blocked downstream of poppet 64 for the reasons described above. Flow blockage is effected by the controlled movement of control valve spool 120 which is held in opposite positions by operably exposing different selected areas on the spool to inlet pressure dependent on spool position, and energized solenoids provide opposite first and second actuating forces to overcome the respective hydraulic holding or detent forces in order to shift spool 120 between its open and closed positions.

While a preferred embodiment of the invention has been set forth in detail, various modifications and alterations will be apparent to those skilled in the art. Accordingly, the foregoing detailed description should be considered exemplary in nature and not as limiting to the scope and spirit of the invention as set forth in the appended claims.

Having described the invention with sufficient clarity that those skilled in the art may make and use it, I claim:

1. A flow control system for providing a controlled, step variable rate of fluid flow, comprising:

a single variable pressure fluid pump source having a discharge duct;

an inlet header communicating with said discharge duct;

a plurality of conduits communicating with said inlet header in parallel flow relationship;

an exhaust header communicating with said conduits in parallel flow relationship for combining fluid flow therefrom into a single exhaust flow;

a separate shut-off means associated with each of said conduits for shifting between a closed position blocking fluid flow through the associated conduit, and an open position;

separate valve means associated with each of said conduits for automatically maintaining a substantially constant, preselected rate of fluid flow through the associated conduit to said exhaust header whenever said associated shut-off means is in said open position, regardless of variations of pressure in said inlet header;

control means for selectively individually shifting each of said shut-off means between said open and closed postions to vary the rate of said single exhaust flow in discrete steps regardless of variations in said inlet header pressure;

override means for substantially simultaneously shifting all of said shutoff means to said open positions when actuated; and manually operable flow varying means disposed in one of said headers for manually varying said single exhaust flow rate whenever said override means is actuated.

2. A system as set forth in claim 1, further comprising a unitary body defining both said inlet and exhaust headers.

3. A system as set forth in claim 2, further comprising web structure affixed to said body and disposed in said exhaust header for directing said fluid flows from said conduits in a common direction prior to said combining of the flows in said exhaust header.

* * * * *